US005215391A

United States Patent [19]

Daley et al.

[11] Patent Number: 5,215,391

[45] Date of Patent: Jun. 1, 1993

[54] RIBBON CASSETTE

[75] Inventors: Phillip B. Daley, Statesville, N.C.; Scott L. Collins, Cincinnati, Ohio

[73] Assignee: NCR Corporation, Dayton, Ohio

[21] Appl. No.: 909,344

[22] Filed: Jul. 6, 1992

[51] Int. Cl.[5] ..... B41J 32/00

[52] U.S. Cl. ..... 400/196.1; 400/208; 400/236.2

[58] Field of Search ..... 400/196.1, 208, 228, 400/235, 235.1, 236, 236.2

[56] References Cited

U.S. PATENT DOCUMENTS

| | | | |
|---|---|---|---|
| 3,726,381 | 4/1973 | Murphy | 197/168 |
| 3,918,569 | 11/1975 | Parker | 197/168 |
| 3,977,512 | 8/1976 | Teagarden et al. | 197/168 |
| 4,091,914 | 5/1978 | Stipanuk | 400/196.1 |
| 4,209,261 | 6/1980 | Bell et al. | 400/196.1 |
| 4,606,662 | 8/1986 | Komplin | 400/208 |
| 4,874,264 | 10/1989 | Suzuki et al. | 400/82 |
| 5,005,999 | 4/1991 | Raar et al. | 400/211 |

FOREIGN PATENT DOCUMENTS 1240947 8/1988 Canada .

*Primary Examiner*—Edgar S. Burr
*Assistant Examiner*—Ren Yan
*Attorney, Agent, or Firm*—Craig E. Miller; George J. Muckenthaler

[57] ABSTRACT

A ribbon cassette has an endless ribbon contained in the cavity of the cassette and the ribbon is directed by guide arms in a path past a printing station. A ribbon drive roller and a driven roller are positioned within the cavity and the drive roller has a shaft connected with a first bevel gear which engages a second bevel gear for driving the ribbon.

10 Claims, 4 Drawing Sheets

RIBBON CASSETTE

BACKGROUND OF THE INVENTION

In the field of ink ribbons for printers, a ribbon supply spool and a ribbon take-up spool have been provided on opposite sides of a typing or printing station, together with means for reversing the direction of travel of the ribbon for repeated use thereof in an arrangement for the purpose of obtaining longer ribbon life. Also, the ink ribbon has been made to travel along a line of printing wherein the supply spool and the take-up spool are positioned beyond the ends of the printing line and the ribbon is caused to travel at an angle relative to the print line to utilize a greater portion of the ribbon width. However, in the case of certain high-speed printers, a ribbon substantially as wide as the line of printing may be used and caused to travel in a direction normal to the print line and in a path along with the record media. Additionally, it has been common to provide ink carrying or containing means operably associated with the ribbon for maintaining or replenishing a supply of ink therein for proper and extended-life printing operations.

In present day printers, it is also common practice to provide and use a ribbon cassette carrying an endless ribbon which is caused to be driven past a printing station, and wherein the printing ribbon is either a pre-inked and disposable ribbon or a ribbon which is to be continuously or frequently re-inked during the printing operation. The ribbon cassette itself may be of the stuffing-box type wherein the ribbon is contained within the cassette in random manner and such ribbon is unfolded at the cassette exit and caused to be driven past the printing station for use thereat and then guided back into the cassette to be folded again in random manner therein. Additionally, a ribbon may be utilized in a Mobius loop configuration within the cassette to obtain longer ribbon life, the ribbon may be in substantially continuous contact with an inking core or like member, or the ribbon may have a plurality of coils thereof around a central core for controlled inking or re-inking of the ribbon.

Representative documentation relating to ribbon cassettes or cartridges includes U.S. Pat. No. 3,726,381, issued to J. B. Murphy on Apr. 10, 1973, which discloses an endless ribbon with a pair of drive rollers for continuously driving the ribbon during at least a portion of the printing operation.

U.S. Pat. No. 3,918,569, issued to R. L. Parker on Nov. 11, 1975, discloses an endless ribbon cartridge wherein the ribbon is wrapped around spaced rollers and is trained in a feed path from between the rollers and across the ends of extended arms.

U.S. Pat. No. 3,977,512, issued to L. O. Teagarden et al. on Aug. 31, 1976, discloses a ribbon cassette mounted on a printer wherein the ribbon is formed in a Mobius loop and is driven by rollers to be randomly stuffed in the cassette chamber and a spring is used to provide proper ribbon tension.

U.S. Pat. No. 4,209,261, issued to D. W. Bell et al. on Jun. 24, 1980, discloses a ribbon cassette having a cavity for containing the ribbon in one plane at an angle and ribbon drive means positioned at such angle for driving the ribbon in an angled path past the printing station.

Canadian Patent No. 1,240,947, granted to NCR Corporation (Inventors T. J. Bossack and L. E Shipos) and issued on Aug. 23, 1988, discloses an endless ribbon cassette having a cavity for containing the ribbon oriented along a path therein and elongated arm means for guiding the ribbon in a path along a line of printing at an angle normal to the path of the ribbon in the cavity.

SUMMARY OF THE INVENTION

The present invention relates generally to ribbon cassettes or cartridges for use in impact printers. More particularly, the present invention relates to an endless ribbon cassette which is removably connected to a printer cabinet, the cassette carrying the ribbon in "stuffing-box" manner and having exit and entrance ports for allowing travel of the ribbon in a path past the printing station.

In accordance with a preferred embodiment of the present invention, there is provided a ribbon cassette having an endless ribbon adapted for use on a printer, comprising a body portion having a cavity for containing said ribbon oriented along a path therein in random manner and said body portion having ribbon entrance and exit ends, drive roller means for driving said ribbon into and out of said cavity, and elongated arm means extending in rigid manner from each side of said body portion at a right angle thereto for guiding said ribbon in a path from the ribbon exit end of the body portion along a line of printing distal from the body portion and back to the ribbon entrance end, said drive roller means including drive gears positioned in angular relationship with each other for driving said ribbon.

The cassette includes a ribbon drive roller and a matching driven roller for driving the ribbon in continuous manner during the printing operation, such drive roller having a first drive gear connected therewith and a second drive gear positioned normal and engaged with said first drive gear for driving thereof. The second drive gear is connected with drive means on the printer to provide a positive connection for driving the ribbon in continuous operation.

In accordance with the above discussion, a principal object of the present invention is to provide a ribbon cassette as a part of the cabinetry of a printer.

Another object of the present invention is to provide a ribbon cassette having means for guiding the ribbon in a path past the line of printing.

An additional object of the present invention is to provide a ribbon drive roller and drive means therefor which is simple and positive for driving the ribbon in continuous manner.

A further object of the present invention is to provide a ribbon cassette with ribbon storage means, ribbon drive means and ribbon guide means in an arrangement to reduce the overall size of the printer.

Still another object of the present invention is to provide ribbon drive means in a ribbon cassette which is arranged in bevel manner for driving the ribbon and thereby positioning the ribbon in a single plane in the travel of the ribbon through the cassette and past the line of printing.

Additional objects and advantages of the present invention will become apparent and fully understood from a reading of the following specification taken together with the annexed drawing.

DESCRIPTION OF THE PREFERRED EMBODIMENT

Figure 1:
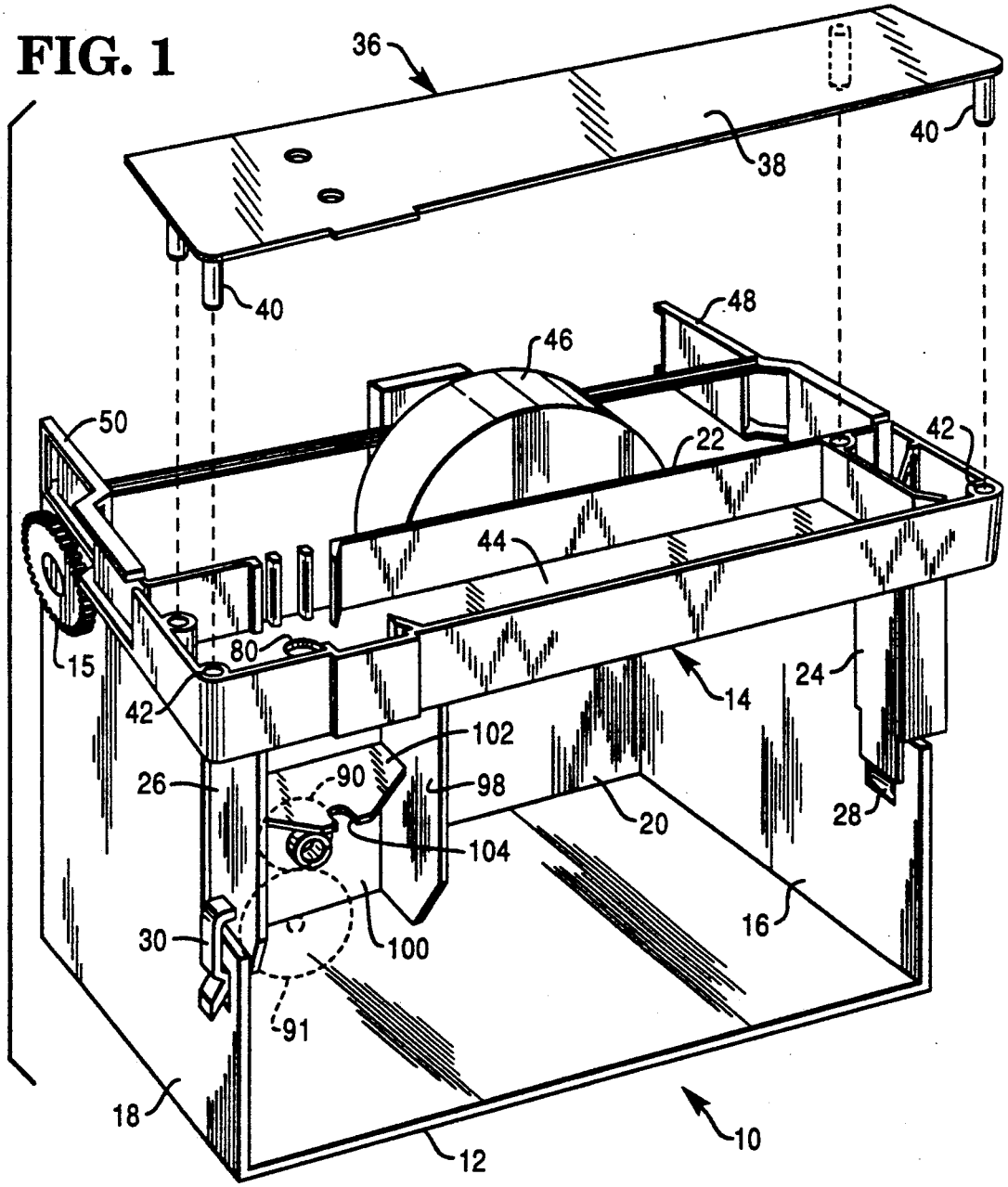
FIG. 1 is a perspective view of a portion of a printer carrying the ribbon cassette of the present invention.

Referring now to FIG. 1, there is shown a printer of the dot matrix type, generally designated as 10, and showing only a portion of the cabinet of the printer to accentuate the parts of the present invention. The cabinet includes an enclosure 12 which assumes a rectangular shape and provides protection for a compact high speed printer. A single drive motor (not shown) is used to provide the driving means for a dot matrix print head 46 (also shown in phantom in FIG. 2) and for ribbon drive means in a ribbon cassette, generally designated as 14. As is well known in the art, the print head 46 and its associated carriage 47 are caused to be driven in a side-to-side direction across the printer by means of a commonly used and continuously driven drum cam (not shown).

A drive gear 15, as part of a drive train for the printer 10, is journaled in the left side wall of the printer and is coupled to the drum cam. A guide rail 17 (shown in phantom in FIG. 2) provides part of the support mechanism for carrying the print head 46 and its associated carriage 47 in side-to-side travel across the printer 10, as indicated by the arrows in FIG. 2.

The printer 10 and the enclosure 12 include side frame members or panels 16 and 18 joined by a frame member 20, the several members providing support for the various elements of the printer including the ribbon cassette 14. An additional frame member or panel may be used to connect the side panels 16 and 18 at the front of the printer 10. However, certain parts of the printer 10 and of the ribbon cassette 14 are omitted in FIG. 1 for clarity.

The ribbon cassette 14 is formed to provide a generally rectangular-shaped base or body portion 22 having side portions or walls 24 and 26 extending downwardly from the body portion (FIGS. 1 and 4) for securing the ribbon cassette 14 to the side panels 16 and 18 of the printer 10. The side portions 24 and 26 include integral spring clips 28 and 30 for connecting or snapping into appropriate recesses provided in the side frame members 16 and 18 for retaining and supporting the ribbon cassette 14 in position on the printer 10. The body portion 22 carries and contains a ribbon 32 in stuffing type or random manner, as shown in FIG. 2.

More specifically, the ribbon 32 is caused to be contained within a cavity or chamber 34 of the body portion 22 in a folded or like layer manner so as to maintain control of the ribbon and prevent twisting or tangling thereof within the chamber. The ribbon cassette 14 has a cover 36 (FIG. 1) which includes a flat portion 38 that covers the chamber 34. The portion 38 includes pins or like elements 40 that match and engage with apertures 42 which are a part of the body portion 22 of the ribbon cassette 14. The body portion 22 includes a bottom portion 44 that serves as a base for the ribbon chamber 34.

Figure 2:
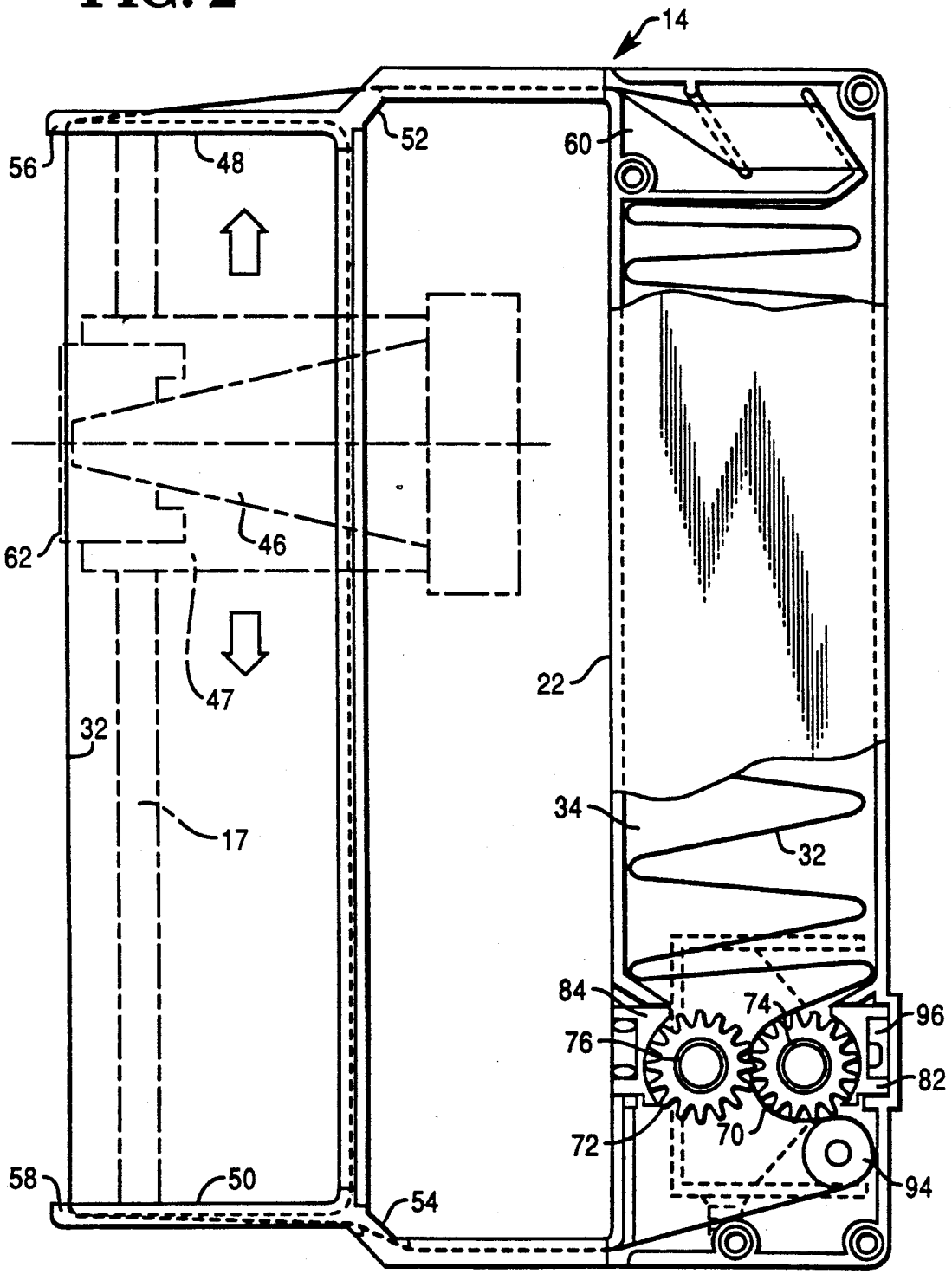
FIG. 2 is a top plan view of the ribbon cassette with portions of the cover removed to show certain of the interior parts.

The ribbon cassette 14 has a pair of elongated arms 48 and 50 extending forwardly in rigid manner from the body portion 22 for the purpose of guiding the ribbon 32 from the body portion in a path therefrom and past the printing station which is exhibited at the front or narrow end of the print head 46 (FIG. 2). The arms 48 and 50 are essentially channel-shaped in form to contain the ribbon 32 therealong and include angle portions 52 and 54 approximately intermediate the ends of the channel-shaped arms. The arms 48 and 50 include end portions 56 and 58 at the outer ends thereof for causing the ribbon to be directed along a precise path past the printing station.

FIG. 2 is a top plan view of the ribbon cassette 14 and has portions of the cover 36 removed to illustrate certain of the interior working parts of the cassette and the path of the ribbon 32 as it moves past the drive means through the cavity 34 and then through a Mobius loop section 60 of the body portion 22. FIG. 2 also shows a portion of paper or like record media 62 adjacent the ribbon 32 and positioned at the printing station for impact by print wires (not shown) of the print head 46.

Figure 3:
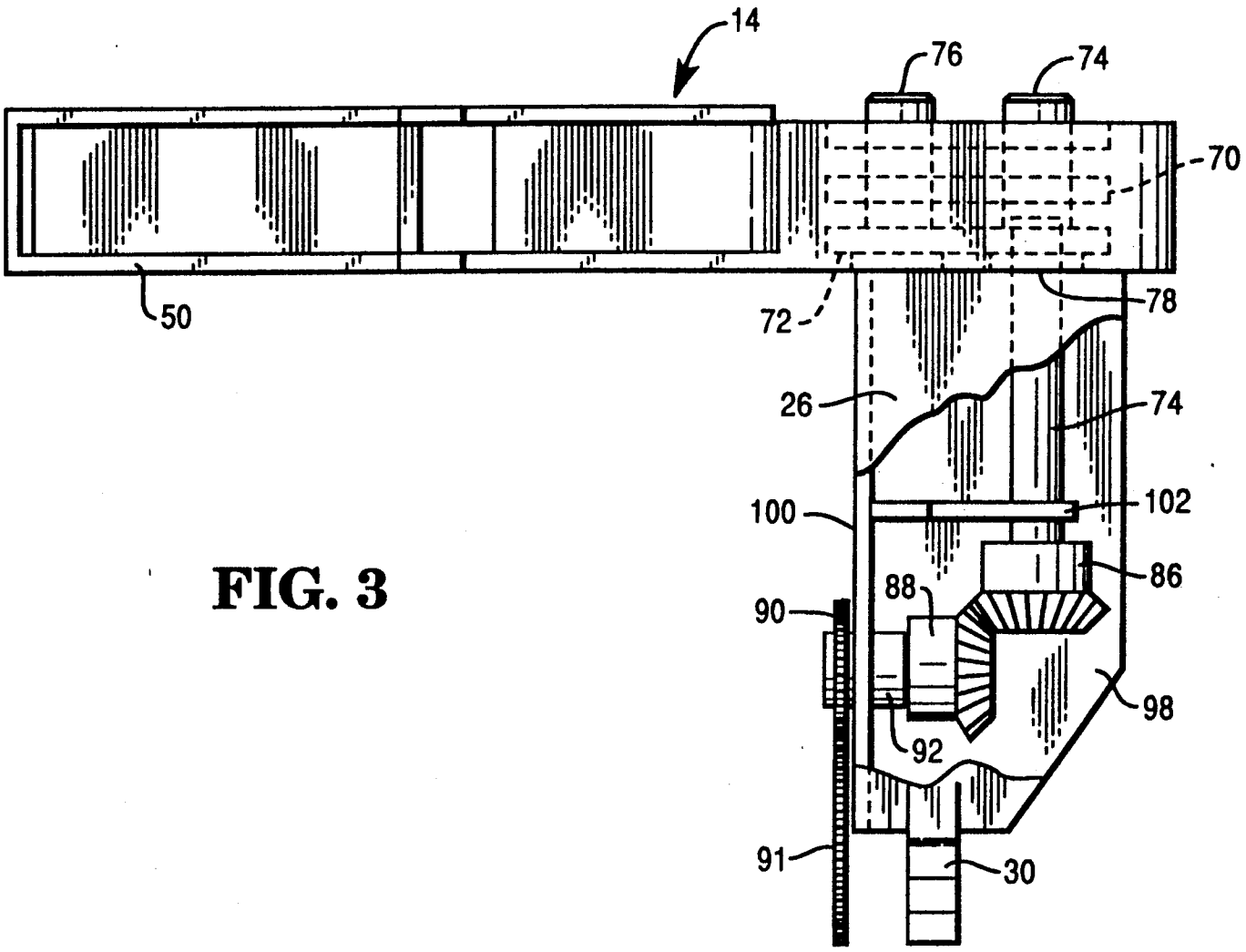
FIG. 3 is the right side elevational view, partially broken away, to show the driving gears for driving the ribbon.

The ribbon drive means of the present invention includes a drive gear or roller 70 and a driven or follower gear or roller 72 (FIG. 2) which are carried on hollow shafts 74 and 76 journaled in apertures 78 and 80 (FIGS. 1 and 3) in the bottom portion 44 of the cavity or chamber 34 of the cassette 14. A fabric or ribbon stripper 82 is provided adjacent the drive roller 70 and a like stripper 84 is provided adjacent the driven roller 72. The drive roller 70 and the shaft 74 are connected to a bevel gear 86 (FIG. 3). The bevel gear 86 engages with a like bevel gear 88 that is coupled to a spur gear 90, in turn coupled to a drive gear 91 (FIGS. 1 and 3) that is coupled to the single drive motor (not shown). A bearing sleeve 94 (FIG. 2) is provided in the corner of the body portion 22 of the cassette 14 and is positioned for training the ribbon 32 therearound prior to engaging the rollers 70 and 72. A tensioner spring 96 is provided in the body portion 22 for biasing the stripper 82 in a direction toward the drive roller 70.

In the present invention each bevel gear 86 and 88 (FIG. 3) is a gear having beveled teeth for transmitting rotary motion at an angle so as to provide an arrangement to maintain a compact printer structure. The vertical gear shaft 74 connects the drive roller 70 with the bevel gear 86 and a horizontal gear shaft 92 connects the bevel gear 88 with the spur gear 90.

Figure 4:
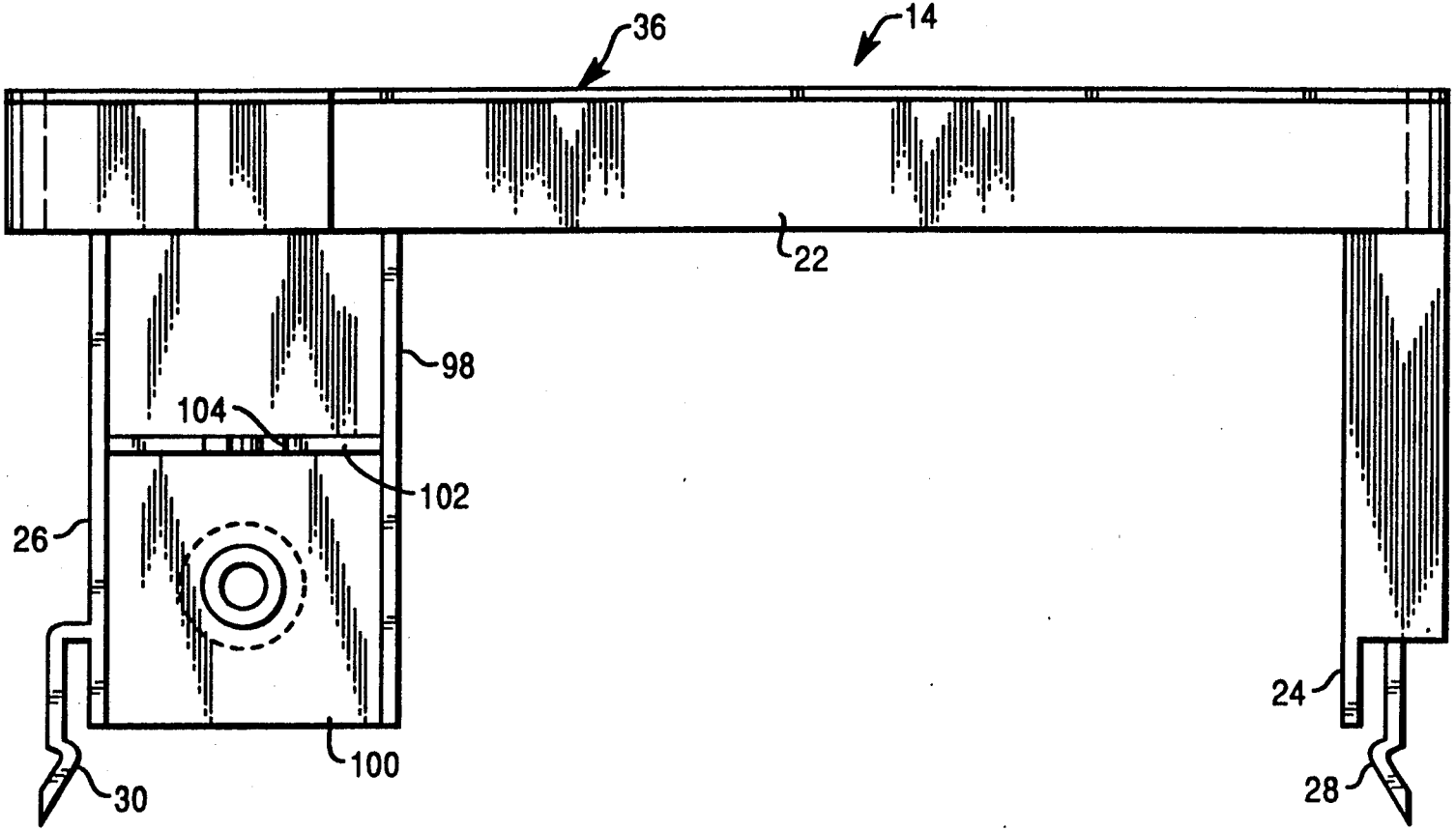
FIG. 4 is a front elevational view of the ribbon cassette.

Support means for the arrangement of the bevel gears 86 and 88 is provided adjacent the side portion or wall 26 (FIGS. 1, 3 and 4). A like side portion or wall 98 is secured to the bottom of the base 44 of the cassette 14 in opposed manner and is connected to the wall 26 by a connecting portion 100. A shelf 102 is connected to the portion 100 and extends therefrom and includes a cutout or notch 104 therein for journaling the vertical shaft 74 (FIG. 2).

It is thus seen that herein shown and described is a ribbon cassette which is easily removable from the printer and wherein the ribbon is caused to be driven in a path from a cavity of the cassette past the printing station by means of the driving rollers which are included in and are a part of the cassette. The cassette is supported independent of movement of the print head carriage or assembly and the drive rollers receive motion in continuous manner from the carriage drive mechanism. The form and the structure of the cassette with the elongated ribbon guide arms allow and provide for reducing the overall size of the printer in a compact arrangement thereof predominantly by reason that the ribbon assumes one orientation within the body portion and in a path past the printing station. The drive mechanism for the ribbon is structured to include bevel gears in an arrangement that also provides for reducing the overall size of the printer.

The cassette as shown and described enables the accomplishment of the objects and advantages mentioned above, and while one embodiment of the invention has been disclosed herein, variations thereof beyond those herein mentioned may occur to those skilled in the art. It is contemplated that all such variations not departing from the spirit and scope of the invention hereof are to be construed in accordance with the following claims.

What is claimed is:

1. A cassette having an endless ribbon therein for use on a printer, said cassette comprising:

a body portion having a cavity containing said ribbon therein in random manner and said body portion having a ribbon entrance end and a ribbon exit end;

elongated arm means extending in rigid manner from each side of said body portion at a right angle thereto for guiding said ribbon in a path from the ribbon exit end of the body portion along a line of printing distal from the body portion and back to the ribbon entrance end, said body portion having spaced side portions extending therefrom for securing said cassette to said printer; and drive means for driving said ribbon into and out of said cavity, said drive means comprising drive roller means and driven roller means positioned in said cavity and engageable with said ribbon for driving thereof and bevel gear means coupled with said drive roller means for driving thereof, said bevel gear means comprising a first bevel gear connected to said drive roller means and a second bevel gear meshing with said first bevel gear for driving thereof, and a support portion spaced from one of said side portions and means connecting said support portion and only said one of said side portions for journaling said first bevel gear.

2. The cassette of claim 1 wherein said drive roller means and said driven roller means are carried by said body portion and urged in ribbon driving relationship adjacent the ribbon entrance end of said body portion.

3. The cassette of claim 1 wherein said bevel gear means comprise a pair of bevel gears positioned in engaging relationship normal with each other for driving said drive roller means and said driven roller means.

4. The cassette of claim 1 wherein said drive roller means comprises a drive roller and a shaft and said bevel gear means comprises a bevel gear integral with said shaft, said shaft being journaled in said support portion.

5. A printer having printing means reciprocable thereacross, said printer comprising:

a ribbon cassette securely carried by said printer and having a body portion for containing an endless ribbon therein and having a ribbon entrance end and a ribbon exit end;

elongated arm means extending in rigid manner from each side of said body portion at a right angle thereto for guiding said ribbon in a path from the ribbon exit end of the body portion along a line of printing distal from the body portion and back to the ribbon entrance end, said body portion having extending side portions for securing said ribbon cassette to said printer; and drive means carried by said cassette for driving said endless ribbon in continuous manner along said path past said line of printing, said drive means comprising drive roller means and driven roller means positioned in said body portion and engageable with said ribbon for driving thereof and bevel gear means coupled with said drive roller means for driving thereof, said bevel gear means comprising a first bevel gear connected to said drive roller means and a second bevel gear meshing with said first bevel gear for driving thereof, and a support portion spaced from one of said side portions and means connecting said support portion and only said one of said side portions for journaling said first bevel gear.

6. The printer of claim 5 wherein said drive roller means and said driven roller means are carried by said body portion and urged in ribbon driving relationship adjacent the ribbon entrance end of said body portion.

7. The printer of claim 5 wherein said bevel means comprise a pair of bevel gears positioned in engaging relationship normal with each other for driving said drive roller means and said driven roller means.

8. The printer of claim 5 wherein said drive roller means comprises a drive roller and a shaft and said bevel means comprises a bevel gear integral with said shaft, said shaft being journaled in said support portion.

9. A ribbon cassette for carrying an endless ribbon for use on a printer, said ribbon cassette comprising:

a body portion having a cavity for containing said endless ribbon in random manner therein and said body portion having a ribbon entrance end and a ribbon exit end;

elongated arm means integral with and extending in rigid manner from each side of said body portion at a right angle thereto for guiding said ribbon in a path from the ribbon exit end of the body portion along a line of printing distal from the body portion and back to the ribbon entrance end, said body portion having side walls extending downwardly at a right angle from said body portion and said side walls having integral spring means for securing said ribbon cassette to said printer; and drive means for driving said ribbon into and out of said cavity, said drive means comprising a drive roller and a driven roller positioned in said cavity and engageable with said ribbon for driving thereof, and a first bevel gear coupled with said drive roller for driving thereof and a second bevel gear meshing with said first bevel gear for driving thereof, and a support wall spaced from one of said side walls and means connecting said support wall and said one of said side walls for journaling said first bevel gear.

10. The ribbon cassette of claim 9 wherein said drive roller comprises a roller and a shaft coupled thereto and said means connecting said support wall and said one of said side walls comprises a shelf and said bevel gear means comprises a bevel gear coupled with said shaft, said shaft being journaled in said shelf.

* * * * *

UNITED STATES PATENT AND TRADEMARK OFFICE

CERTIFICATE OF CORRECTION

PATENT NO. : 5,215,391

DATED : June 1, 1993

INVENTOR(S) : Phillip B. Daley et al.

It is certified that error appears in the above-identified patent and that said Letters Patent is hereby corrected as shown below:

Column 5, line 17, after "cavity" insert --for--.

Signed and Sealed this

Twenty-first Day of June, 1994

*Attest:*

Bruce Lehman

BRUCE LEHMAN

*Attesting Officer*

*Commissioner of Patents and Trademarks*